United States Patent [19]

Collard

[11] 4,270,123

[45] May 26, 1981

[54] DETECTOR FOR INDICATING A FIRE OR DETECTOR MALFUNCTION

[75] Inventor: Jean-Claude Collard, Brussels, Belgium

[73] Assignee: Universal Det, S.A.R.L., Boulogne, France

[21] Appl. No.: 15,052

[22] Filed: Feb. 26, 1979

[51] Int. Cl.³ ..... G08B 17/10

[52] U.S. Cl. ..... 340/629; 340/510; 340/693

[58] Field of Search ..... 340/629, 510, 506, 693

[56] References Cited

U.S. PATENT DOCUMENTS

| | | | |
|---|---|---|---|
| 3,320,602 | 5/1967 | Andrews | 340/510 |
| 3,795,904 | 3/1974 | Beyersdorf et al. | 340/629 |
| 3,866,195 | 2/1975 | Ried, Jr. | 340/629 |
| 4,028,689 | 6/1977 | Schopp | 340/510 |

FOREIGN PATENT DOCUMENTS

| | | |
|---|---|---|
| 1351145 | 1/1964 | France . |
| 1453433 | 9/1966 | France . |

OTHER PUBLICATIONS pp. 84–86, *Electronic Design,* vol. 23, No. 12, Jun. 1975.

*Primary Examiner*—Glen R. Swann, III

*Attorney, Agent, or Firm*—Sandler & Greenblum

[57] ABSTRACT

A fire detector provided with a warning system, a reference element and an analysis element whose impedance varies in the presence of a rise of temperature and/or radiation and/or combustion gas, said reference and analysis elements being connected in series or in parallel and constituting two adjacent arms of a Wheatstone bridge assembly. The other two arms are constituted by resistors if necessary variable while the measuring diagonal or bridge, joins, either the common connecting points of the resistors and said elements, or respectively the ends of the detector elements. This device is distinguished in that the two ends of the bridge (X and Y) are connected respectively to the two inputs of two voltage comparators ($A_1$ and $A_2$), mounted in parallel and in reverse, each connected to a warning system ($S_1$, $S_2$) so that unbalance of the bridge creates a signal at the output of one or other comparator according to the direction of unbalance and actuates the corresponding warning system to indicate, respectively, a fire or system malfunction.

13 Claims, 4 Drawing Figures

DETECTOR FOR INDICATING A FIRE OR DETECTOR MALFUNCTION

BACKGROUND OF THE INVENTION

1. Field of the Invention

The invention relates to a fire detector.

2. Description of the Prior Art

Numerous types of fire detectors or alarms exist, such as temperature rise detectors generally comprising thermistors, detectors of radiation emitted by a flame and including photoelectric cells or a brush discharge tube and smoke or combustion gas detectors. The latter are based on optical phenomena or even include at least one ionization chamber traversed by a current which varies according to the gases passing through it.

All these devices are connected electrically to a warning or alarm system controlled by a device which establishes the difference between a measured value and a reference value corresponding to a normal or tolerable level. These devices generally require a considerable consumption of current which is particularly heavy considering that they operate continuously. In addition, they are sensitive to disturbing external phenomena and use, for the ionization detectors, considerable radioactive sources.

It is an object of the invention to provide a particularly reliable and low comsumption electronic system for fire detection purposes. This is based on a comparative measurement between a measured value and a reference value.

It is another object of the invention to provide a warning system in the case of faulty operation of the fire detection device.

Other objects and advantages of the fire detector system according to the invention will be understood on reading the description which follows.

GENERAL DESCRIPTION OF THE INVENTION

The fire detection system according to the invention is designed to be adapted to numerous types of electrical detectors which include a warning or alarm system, a reference element and an analysis element whose impedance varies in the presence of a rise of temperature and/or of radiation and/or combustion gas, said reference and analysis elements being connected in series or in parallel and constituting two adjacent arms of a Wheatstone bridge circuit whose two other arms are constituted by resistors, if necessary variable, whilst the measuring diagonal or bridge, joins, either the common connecting points of the resistors and said elements, or respectively the ends of the detector elements.

The device according to the invention is remarkable in that the two ends of the bridge are connected respectively to two inputs of two voltage comparators, mounted in parallel and in reverse, each connected to a warning system such that unbalance of the bridge creates a signal at the output of one or other comparator according to the direction of unbalance and actuates the corresponding warning system.

Advantageously, in this case hysteresis is created between the two triggering actions by means, for example, of a voltage divider bridge arranged at one of the inputs of one of the comparators.

Experience shows that the comparators are advantageously constituted by linear amplifiers whose gain is programmable.

It has been found, moreover, after numerous studies and tests that the amplifiers which permit good operation are integrated operational amplifiers known by the connotations LM 4250 or $\mu$A 776.

It is clear that this arrangement is adaptable to numerous types of detectors and the reference and analysis elements may be constituted by brush discharge tubes sensitive to radiation or thermistors sensitive to rise in temperature or ionization chambers sensitive to combustion gases.

Ionization chambers may, in addition, include electrodes at reduced voltage one of which is provided with a radioactive source or electrodes subject to high voltage with or without a radio-element.

It is also possible for one at least of the comparators to be preceded by at least one impedance adaptor device such as a field effect transistor.

In the case of a detector whose reference and analysis elements are constituted by two radioactivity ionization chambers provided if necessary with a common electrode, it has appeared to be particularly important for the height (i.e., electrode spacing) of the analysis and reference chambers to be respectively 12.5 mm and 7.5 mm.

A device according to the invention possesses high sensitivity due to its measurement by comparsion, and enables a fire warning system or a fault warning system to be actuated according to the direction of unbalance of the bridge. In its application to ionization detectors, the invention enables the use of weak radioactive sources, which represents a considerable advantage in view of the strict regulations to which such sources are subject and the risk of contamination which exists with highly radioactive sources.

To make even weaker the radioactive sources used in the detectors it has been conceived to increase even more the voltage applied to the chambers.

However, it has appeared contrary to the ideas received that this voltage had to be limited. Study of the ionization phenomenon shows that the graph of the ionization current as function of the voltage applied to the system, has several zones.

In the first zone, so-called recombination zone, certain of the ions contained in the chamber recombine together. This zone has hitherto been very little used in contrast with the other zones such as the ionization chamber zone, the proportional counter zone or the Geiger-Muller zone. The inventor has discovered that this recombination zone which hence corresponds to a poor ionization chamber was partivularly sensitive to smoke or combustion gases. Consequently, according to one embodiment of the invention in which at least the analysis element is constituted by a radioactivity ionization chamber, the voltage applied to the terminals of this analysis chamber is situated in this so-called recombination zone of its graph of the ionization current as a function of the applied voltage.

In addition, it has been found particularly advantageous if the reference element be constituted by the internal resistance of a field effect transistor arranged in the bridge circuit. In fact, this very considerable internal resistance varies as a function of the external parameters, other than the combustion gases, substantially in the same manner as the analysis chamber and hence constitutes a good reference element.

In this case, it is advantageous for the source of the field effect transistor to be connected to ground through a variable resistor which enables the internal resistance of the field effect transistor to be varied.

It is then possible, by means of this variable resistance to adjust the voltage applied to the analysis chamber and in the case of parallel mounting to adjust the balance of the bridge.

To economize in energy, according to one embodiment, the detector is provided with a low voltage general supply source and with a higher voltage generator for the analysis and reference elements controlled in voltage by a regulator designed and arranged so as to deliver voltage to said generator only when the voltage of the latter remains less than a reference voltage.

In this case the regulator is advantageously constituted by a comparator of which one of the inputs is connected to a reference voltage source and the other input to a point in the circuit situated downstream of the generator.

BRIEF DESCRIPTION OF THE DRAWINGS

The invention will be better understood and other features will appear more clearly from reading the description which follows with reference to the accompanying drawing, in which.

DESCRIPTION OF PREFERRED EMBODIMENTS

Ionization detectors are known and include at least one chamber in which a radioactive material is placed intended to ionize said chamber. When smoke or combustion gases enter the chamber, the ionization state is modified so that the number of mobile charges diminishes, which amounts to an increase in the internal impedance of the chamber.

Figure 1:
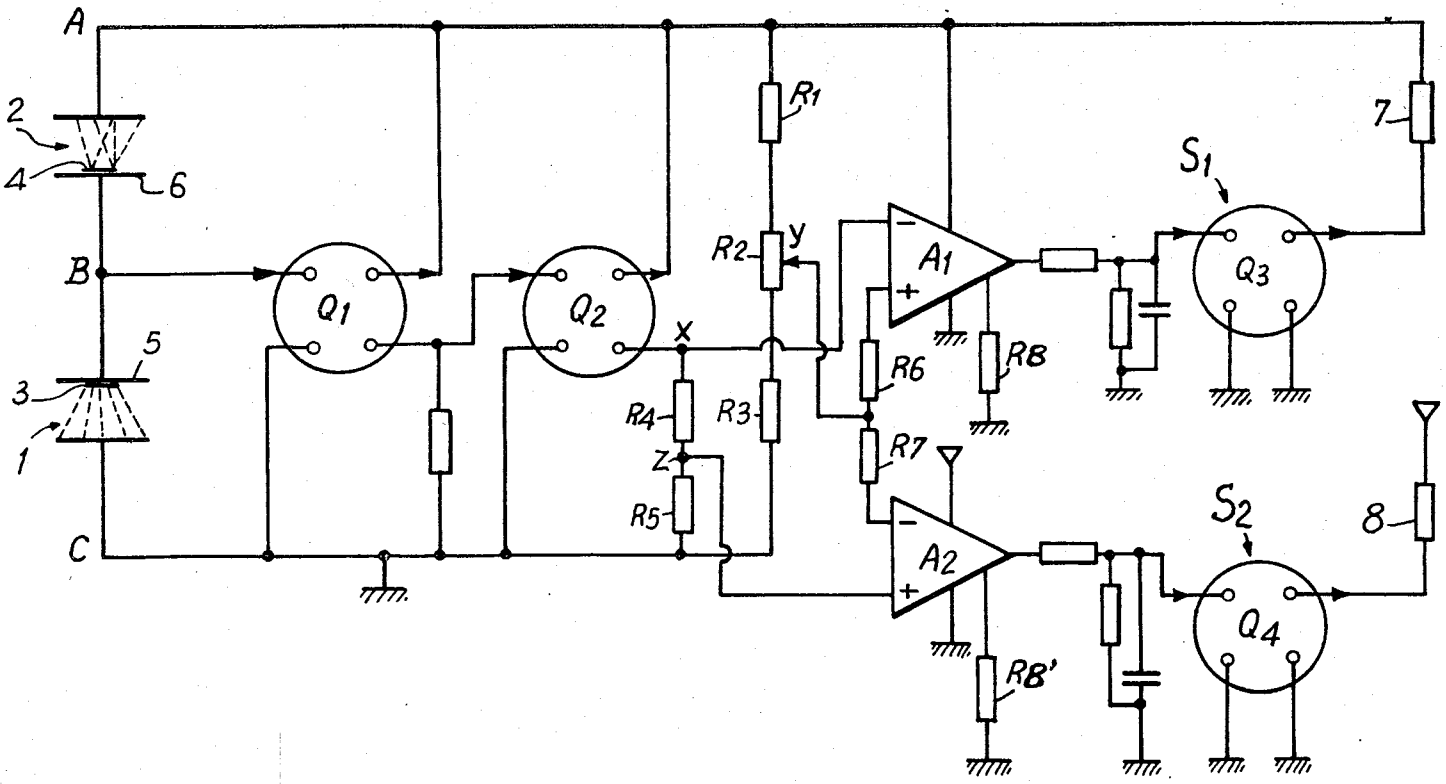
FIG. 1 shows diagrammatically, a first embodiment of a detector according to the invention, provided with two ionization chambers.

In the example shown in FIG. 1, the device includes two ionization chambers 1 and 2 respectively for analysis and reference connected in series. Each of the latter is provided with a radioactive material 3 and 4. The chambers are arranged so that the positive electrode 5 of the analysis chamber 1 and the negative electrode 6 of the reference chamber are connected to the common point B whilst a current source is connected between the points A and C, that is to say between the positive and negative electrodes of the respective chambers 2 and 1. (Source of 18 to 30 V, for example).

The common point B is connected electrically to the input of a quadripole $Q_1$ itself followed by a quadripole $Q_2$. The quadripoles $Q_1$ and $Q_2$ are four-terminal impedance adaptors (e.g., field effect transistors) designed to lower the high output impedance of the chambers. It is obviously possible to use only a single impedance adaptor quadripole, such as a field effect transistor, for example, or any other equivalent component.

Three resistors in series $R_1$, $R_2$ and $R_3$ are connected in parallel between the points A and C, the resistor $R_2$ being arranged as a potentiometer. The output X of the quadripole $Q_2$ and a variable point Y on the resistor $R_2$ are respectively connected to the negative and positive inputs of an operational amplifier $A_1$. The output X is, in addition, connected through a resistor $R_4$ to the positive input of an operational amplifier $A_2$, whilst the point Y is connected electrically to the negative input of the latter. The point Y is therefore connected to the positive and negative inputs respectively of the amplifiers $A_1$ and $A_2$, through, in the example shown, two input resistors $R_6$ and $R_7$.

The operational amplifiers $A_1$ and $A_2$ used as a comparator are advantageously programmable by means of the resistors $R_B$ and $R_{B'}$. The resistor $R_4$ arranged between the point X and the input of the amplifier $A_2$ constitutes one of the resistors of a divider bridge $R_4$, and $R_5$ whose middle point Z is directly connected to the above-mentioned input.

It is clear that the chambers 1 and 2 constitute two adjacent arms of a Wheatstone bridge, the two other arms being formed by the resistors $R_1$, $R_3$ and the variable resistor $R_2$ arranged between the latter whilst the measuring diagonal or bridge is comprised between the points X and Y.

The amplifiers $A_1$ and $A_2$ are respectively connected to warning systems $S_1$ and $S_2$ including, notably, quadripoles $Q_3$, $Q_4$ and resistors or relay coils 7 and 8 designed to actuate any suitable light means and/or other relays.

When the voltage at X is less than the input voltage of the amplifier $A_1$, the latter trips and a signal triggers the warning system $S_1$. On the other hand, when the voltage Z is higher than the input voltage of the amplifier $A_2$, the latter trips and actuates the system $S_2$.

FIG. 1 shows two chambers 1 and 2 diagrammatically. In practice, the latter are arranged in a box, possibly a common box, the analysis chamber 1 being open and the reference chamber 2 completely or partly closed.

The operation of the system is easy to understand. The potentiometer $R_2$ is adjusted so that the bridge is balanced. If external phenomena other than smoke emmisions modify the impedances of the two chambers, the bridge is not thrown out of balance and no warning system is actuated. On the other hand, if combustion gases enter the analysis chamber, the current which passes through it is modified and the voltage at the point Z becomes higher than the input voltage of the amplifier $A_2$, which triggers the fire warning system $S_2$. On the other hand, if the unbalance of the bridge takes place in the other direction, that is to say if the voltage at the point X becomes less than the input voltage of the amplifier $A_1$, it is the fault or failure warning system $S_1$ which is triggered. This triggering takes place, for example, following a deterioration of the impedance adaptor quadripoles $Q_1$, $Q_2$ or a breakage of the resistor arms or again, following poor adjustment of the potentiometer $R_2$, etc.

The divider bridge $R_4$, $R_5$ enables a triggering threshold to be set by shifting the balance point of the bridge, so as to produce hysteresis between the triggering of fire and fault warnings respectively. This arrangement enables the sudden passage from one state to the other to be avoided.

In the device described, it has appeared to be particularly advantageous to use as the electronic components for the amplifers $A_1$ and $A_2$, the above-mentioned operational amplifiers. In the same way the impedance adaptors may be provided in the form of a single field effect transistor, for example of the 2N 4416 type. In addition, the height of each of the chambers is important and it has already been stated that the analysis and reference chambers 1 and 2 advantageously have heights of 12.5 mm and 7.5 mm.

Figure 4:
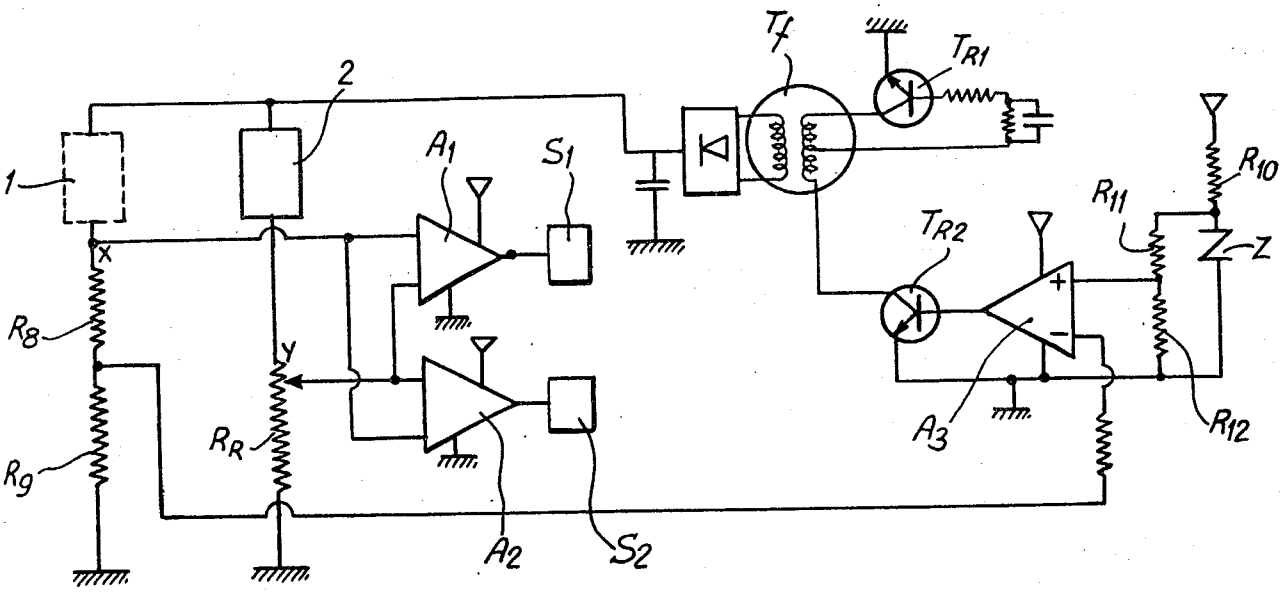
FIG. 4 shows an embodiment with a parallel arrangement and provided with a voltage generator and a regulator.

It is clear that the series arrangement of the chambers 1 and 2 is not obligatory and it is possible to conceive an arrangement in parallel on the supply, the chambers 1 and 2 constituting nonetheless two adjacent arms of the bridge arrangement as is shown in FIG. 4, for example, which will be discussed below.

Figure 2:
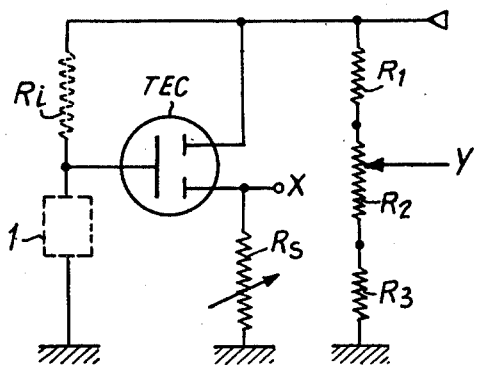
FIG. 2 shows a series arrangement similar to that of FIG. 1 in which the reference element is constituted by the internal resistance of a field effect transistor.
Figure 3:
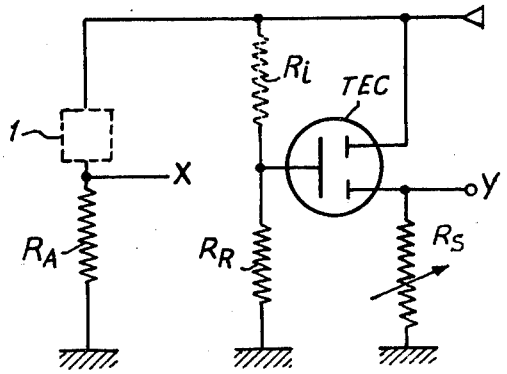
FIG. 3 shows an embodiment similar to that of FIG. 2, but with an arrangement in parallel.

FIGS. 2 and 3 show two very important embodiments of devices according to the invention. They show diagrammatically a series arrangement (FIG. 2) similar to that of FIG. 1 and a parallel arrangement (FIG. 3) similar to that of FIG. 4. However, here the reference element (chamber 2 of FIGS. 1 and 4) is replaced by the internal resistance Ri of a field effect transistor TEC, the resistance Ri being shown in a dashed line since it is an imaginary resistance.

FIG. 2 takes up the series arrangement of FIG. 1 and the resistors $R_1$, $R_2$ and $R_3$ are again to be found as well as the ends of the bridge X and Y. This arrangement is particularly advantageous, since it enables the use of a very weak radioactive source of the order, for example, of 0.05 $\mu$C, that is to say, 1850 disintegrations per second. In fact, this low radioactivity results in a high impedance of the analysis chamber 1, compensated by the internal resistance Ri of high value. In addition, if the bridge is adjustable by means of the variable resistor $R_2$, it is possible to adjust the balance point by means of a variable load resistor $R_s$ arranged at the source of the TEC transistor which enables the internal resistance Ri to be modified. This adjustment thus permits the use of a wide range of radioactive sources.

FIG. 3 shows also a bridge arrangement with an analysis chamber 1, a reference element constituted by the internal resistance Ri of the TEC transistor and resistors $R_A$ and $R_R$ constituting the two other arms of the bridge. However, to adjust the balance of the bridge, instead of having a variable resistor $R_R$, it is advantageous to provide as in FIG. 2, a variable load resistor $R_s$ at the source of the TEC which permits the resistance Ri to be varied.

In addition, as has been stated, the voltage applied to the terminals of the analysis chamber is situated in the recombination zone of the latter.

FIG. 4 shows an advantageous embodiment with two ionization chambers, respectively for analysis and reference 1 and 2, as in FIG. 1, but connected in parallel. In this embodiment, the point Y is adjustable to the resistance $R_R$ of the reference chamber (similar to that of FIG. 3) whilst the resistance $R_A$ of the analysis chamber of FIG. 3 is constituted by two resistors $R_8$ and $R_9$. This embodiment includes, as that of FIG. 1, comparators $A_1$ and $A_2$ and warning systems shown diagrammatically at $S_1$ and $S_2$.

However, this embodiment is provided with a fairly low voltage supply, shown by small triangles, whilst chambers 1 and 2 are supplied by a higher voltage generator (or the order, for example, of 15 to 30 volts) which includes in the example shown, an oscillator and a high permeability transformer Tf, for example $\mu > 1000$ gauss, provided with two primary windings in series and a secondary winding. The oscillations are maintained by a transistor $T_{R1}$ controlled in voltage by a regulator including an operational amplifier $A_3$ mounted as a comparator and a transistor $T_{R2}$. The positive or non-inverting input of the amplifier $A_3$ is connected to a divider bridge constituted by resistors $R_{10}$, $R_{11}$, $R_{12}$ and the Zener diode Z which delivers a reference voltage, whilst the negative or inverting input of said amplifier is connected to the circuit between the resistors $R_8$ and $R_9$ which constitute a divider bridge with the analysis chamber 1. With this arrangement, the amplifier $A_3$ only delivers voltage to the oscillator when the voltage thus tapped has not reached the reference voltage applied to its positive input, so that the secondary voltage at the oscillator is controlled, whilst its consumption is dependent on the secondary utilization consumption, which is particularly low in this embodiment.

It is obvious that the embodiments described may be subject to a large number of modifications or be combined without departing from the scope of the invention. In addition, the analysis elements described are constituted by radioactivity ionization chambers and it is clear that the latter could be replaced by electrodes subjected to high voltage by means of a generator of the type described with reference to FIG. 4 or by other heat or radiation detector means. Finally, the embodiments of FIGS. 1, 2 and 3 may obviously utilize a generator and a regulator of the type described with reference to FIG. 4.

I claim:

1. A detector for a predetermined condition such as a rise in temperature or the presence of radiation or combustion gas comprising a reference element and an analysis element whose impedance varies as a function of said predetermined condition connected together as two arms of a Wheatstone bridge whose other two arms are constituted by resistors, a measuring diagonal of the bridge being connected to a pair of voltage comparators for respectively triggering warning systems, each of the comparators having input terminals of opposite polarity and an output terminal that produces a control signal when the voltage on the positive input terminal exceeds the voltage on the negative input terminal, the improvement comprising: connecting one end of the measuring diagonal to respective input terminals of opposite polarity of the comparators, connecting the other end of the measuring diagonal to the other input terminal of a first of the comparators and to the other input terminal of a second of the comparators whereby control signals produced by the first and second comparators, in response to unbalancing of the bridge, trigger respective warning systems that indicate the existence of a fault and the existence of said predetermined condition.

2. Detector according to claim 1, includng hysteresis means to create a hysteresis between triggering of the two warning systems.

3. Detector according to claim 2, wherein said hysteresis means is a voltage divider arranged at the other input of the one of the comparators.

4. A detector according to claim 2 wherein said hysteresis means is a resistor interposed between said other end of the measuring diagonal and said other input terminal of said second comparator.

5. Detector according to claim 1, wherein the comparators are constituted by linear amplifiers whose gain is programmable.

6. Detector according to claim 5, wherein the amplifiers are integrated operational amplifiers known by the references LM 4250 or $\mu$ A776.

7. Detector according to claim 1, wherein at least one of the comparators is preceded by at least one impedance adapter device ($Q_1$, $Q_2$) comprising a field effect transistor.

8. Detector according to claim 1 whose reference and analysis elements are constituted by two radioactivity ionization chambers provided with a common electrode and two other electrodes, wherein the space between the common electrode and the first of the other electrodes of the analysis chamber is substantially 12.5 mm and the space between the common electrode and the second of the other electrodes of the reference chamber is substantially 7.5 mm.

9. Detector according to claim 1 in which at least the analysis element is constituted by a radioactivity ionization chamber, wherein the voltage applied to the terminals of this analysis chamber is situated in the so-called recombination zone of the ionization current versus applied voltage curve.

10. Detector according to claim 1, whose analysis element is constituted by a radioactivity ionization chamber and wherein the reference element is constituted by the internal resistance (Ri) of a field effect transistor (TEC) arranged in the bridge assembly.

11. Detector according to claim 10, wherein the source of the field effect transistor (TEC) is connected to ground through a variable resistance (Rs) which enables the internal resistance of the field effect transistor to be varied.

12. Detector according to claim 1, provided with a general supply low voltage source and with a generator of higher voltage for the analysis and reference elements controlled in voltage by a regulator designed and arranged so as to deliver voltage to said generator only when the voltage of said generator remains less than a reference voltage.

13. Detector according to claim 12, wherein the regulator is constituted by a comparator ($A_3$) of which one of the inputs is connected to a reference voltage source and the other input to a point of the circuit situated downstream of the generator.

* * * * *

UNITED STATES PATENT AND TRADEMARK OFFICE

CERTIFICATE OF CORRECTION

PATENT NO. : 4,270,123

DATED : May 26, 1981

INVENTOR(S) : Jean-Claude COLLARD

It is certified that error appears in the above—identified patent and that said Letters Patent is hereby corrected as shown below:

In the Abstract, line 1, after "detector", --is-- should be inserted;

line 8, after "resistors", --,-- should be inserted;

line 8, after "necessary", --,-- should be inserted; and line 9, "," (both occurrences) should be deleted.

Column 1, line 6, "1." should be deleted; and line 8, "2." should be deleted.

Signed and Sealed this

*Eighteenth* Day of *August 1981*

[SEAL]

*Attest:*

GERALD J. MOSSINGHOFF

*Attesting Officer*

*Commissioner of Patents and Trademarks*